US006040826A

United States Patent [19]

Furukawa

[11] Patent Number: 6,040,826

[45] Date of Patent: Mar. 21, 2000

[54] DRIVING CIRCUIT FOR DRIVING SIMPLE MATRIX TYPE DISPLAY APPARATUS

[75] Inventor: Hiroyuki Furukawa, Ueno, Japan

[73] Assignee: Sharp Kabushiki Kaisha, Osaka, Japan

[21] Appl. No.: 08/958,213

[22] Filed: Oct. 27, 1997

[30] Foreign Application Priority Data

Oct. 30, 1996 [JP] Japan ..... 8-288855

[51] Int. Cl.[7] ..... G09G 5/00

[52] U.S. Cl. ..... 345/196; 345/98; 345/100; 345/103; 345/508

[58] Field of Search ..... 345/98, 100, 103, 345/104, 196, 197, 513, 508, 511, 512, 518

[56] References Cited

U.S. PATENT DOCUMENTS

| | | | |
|---|---|---|---|
| 5,485,173 | 1/1996 | Scheffer et al. | 345/100 |
| 5,489,919 | 2/1996 | Kuwata et al. | 345/100 |
| 5,596,344 | 1/1997 | Kuwata et al. | 345/103 |
| 5,602,559 | 2/1997 | Kimura | 345/89 |
| 5,621,425 | 4/1997 | Hoshino et al. | 345/94 |
| 5,670,973 | 9/1997 | Bassetti, Jr. et al. | 345/58 |
| 5,706,482 | 1/1998 | Matsushima et al. | 345/521 |
| 5,754,157 | 5/1998 | Kuwata et al. | 345/100 |
| 5,900,856 | 5/1999 | Iino et al. | 345/100 |
| 5,900,857 | 5/1999 | Kuwata et al. | 345/100 |
| 5,929,832 | 7/1999 | Furukawa et al. | 345/98 |

FOREIGN PATENT DOCUMENTS 8-263015 10/1996 Japan .

OTHER PUBLICATIONS

Kudo, Yasuyuki et al., "Study on Driving Methods for Fast–Responding STN–LCDs", The Institute of Electronics, Information and Communication Engineers, Technical Report of IEICE, EID94–129, ED94–157, SDM94–186, 1995, pp. 13–18.

*Primary Examiner*—Richard A. Hjerpe
*Assistant Examiner*—Henry N. Tran
*Attorney, Agent, or Firm*—Nixon & Vanderhye P.C.

[57] ABSTRACT

A driving circuit for a simple matrix type display apparatus in which an input data signal is stored in a frame buffer and subjected to orthogonal transformation, whereby a display is performed, includes: a plurality of line buffers whose number is equal to the number of scanning lines to be selected in accordance with a multiple-scanning line simultaneous selection method, respectively having a region I and a region II, wherein while one of the regions I and II is used for writing, the other is used for reading; and a frame buffer which allows data from the plurality of line buffers to be written during a plurality of horizontal non-display periods and all of the selected scanning lines of data to be written at a time, wherein the number of the plurality of line buffers is equal to the number of the selected scanning lines.

8 Claims, 7 Drawing Sheets

| Vertical Synchronizing frequency | Front porch | Back porch | Synchronizing pulse width | Display period | Vertical period |
|---|---|---|---|---|---|
| Hz | Line | | | | |
| 60 | 1 | 23 | 4 | 600 | 628 |

| Horizontal Synchronizing frequency | Front porch | Back porch | Synchronizing pulse width | Display period | Horizontal period |
|---|---|---|---|---|---|
| kHz | Dot | | | | |
| 37.8 | 40 | 88 | 128 | 800 | 1056 |

| Dot clock |
|---|
| MHz |
| 40.0 |

*FIG. 9A* Operation order on upper screen portion

1MSB → 2MSB → 1LSB → 2LSB → 1MSB 1 cycle

*FIG. 9B* Operation order on lower screen portion

3LSB → 4LSB → 3MSB → 4MSB → 3LSB 1 cycle

| | | | |
|---|---|---|---|
| T | O | T | O |
| O | T | O | T |
| T | O | T | O |
| O | T | O | T |

T :Selected state
O :Non-selected state

DRIVING CIRCUIT FOR DRIVING SIMPLE MATRIX TYPE DISPLAY APPARATUS

BACKGROUND OF THE INVENTION

1. Field of the Invention

The present invention relates to a driving circuit for a simple matrix type display apparatus in which an input data signal is subjected to orthogonal transformation with an orthogonal function, and the transformed signal is subjected to reverse transformation for display on a side of a simple matrix type display apparatus.

2. Description of the Related Art

Conventionally, simple matrix type liquid crystal display apparatuses typified by Super Twisted Nematic (STN) liquid crystal display apparatuses are known.

This type of liquid crystal display apparatus has a structure in which a liquid crystal layer is interposed between two opposing glass substrates, and stripe-shaped scanning electrodes and data electrodes are disposed in a matrix so as to cross each other on the liquid crystal layer side of the glass substrate. In such a liquid crystal display apparatus, a voltage is applied to the scanning electrodes and the data electrodes, whereby liquid crystal at each crossed portion of the electrodes is supplied with an electric field. A display is performed by utilizing the rapid changes in optical characteristics of liquid crystal.

As described above, the simple matrix type liquid crystal display apparatus has a simple panel structure produced by a simple process, so that it can satisfy the requirements of screen enlargement at a relatively low cost.

An STN liquid crystal display apparatus is driven by time division driving (called a line sequential driving or Duty driving) which is described below.

In a simple matrix type liquid crystal display apparatus, a plurality of pixels are provided in one electrode, so that the pixels are driven with an applied voltage in the form of a time-divided pulse. In general, a group of scanning electrodes are scanned by line sequencing at a frame period of 20 ms or less. More specifically, a large selection pulse is applied to one scanning electrode only once per frame, and in synchronization with the pulse, a data signal corresponding to a display pattern is supplied from a data electrode to the pixels. This is repeated every horizontal synchronization period, thereby driving the pixels.

Liquid crystal which is driven as described above generally responds to an effective value of the driving voltage. That is, in a conventional STN liquid crystal display apparatus, the response speed of liquid crystal is relatively slow (i.e., about 300 ms), so that liquid crystal responds in accordance with an ON/OFF ratio of an effective voltage applied in line sequential driving. Thus, a practical optical contrast has been obtainable.

However, when a high response of liquid crystal which is capable of displaying moving images is realized by decreasing the viscosity of the liquid crystal and/or making a liquid crystal layer thinner in an STN liquid crystal panel, the liquid crystal molecules will have a faster response to a driving waveform. This deviates from a response to an effective value and consequently a so-called frame response phenomenon occurs.

The frame response phenomenon refers to a phenomenon where OFF transmittance is increased in a non-selected pixel (OFF display pixel), and actual transmittance is decreased in a selected pixel (ON display pixel) in spite of the fact that an optimum effective voltage is applied thereto. Thus, when conventional line sequential driving is applied to an STN liquid crystal panel having a high response, a display contrast markedly decreases.

In contrast, a multiple scanning line simultaneous selection method (called active driving as opposed to Duty driving) for simultaneously and selectively driving a plurality of scanning lines during one frame period has been described. According to the active driving method, a small scanning line selection pulse is applied to one scanning electrode a plurality of times during one frame period, and an accumulated response effect of liquid crystal is utilized, whereby the occurrence of the frame response phenomenon is suppressed in the high-response liquid crystal.

A specific driving circuit is shown in FIG. 11. As shown in this figure, an input image signal is subjected to orthogonal transformation in an orthogonal transformation circuit 101 which receives an orthogonal matrix from an orthogonal function 100. The transformed signal is supplied to a liquid crystal panel 104 by a data driver 102 from a data electrode side. The orthogonal matrix used for transformation is also supplied to the liquid crystal panel 104 as a scanning voltage pulse by a scanning driver 103 from a scanning electrode side. The transformed signal is then subjected to reverse transformation on the liquid crystal panel 104 side, whereby the input image signal is reproduced.

According to the active driving method, even when a selection pulse is simultaneously applied to a plurality of scanning electrodes, each pixel can be supplied with the same effective voltage as that in the conventional line sequential driving method. Thus, a normal display can be obtained.

The above-mentioned active driving method can be largely classified into two kinds, depending upon the method for selecting the scanning electrodes. One type of active driving method is an active addressing (AA) method (T. J. Scheffer, et al., SID '92, Digest, p. 228, Japanese Laid-open Publication No. 5-100642, and the like). According to the AA method, a WALSH function or the like is used as an orthogonal function, and a positive or negative voltage derived from the function is simultaneously applied to all the scanning electrodes. The other active driving method is a multiple line selection (MLS) method, typified by a sequence addressing method (T. N. Ruckmongathan et al., Japan Display 92, Digest, p. 65, Japanese Laid-open Publication No. 5-46127, and the like). According to the MLS method, one frame period is equally divided into a plurality of periods, and a plurality of different scanning lines in each period are simultaneously selected.

The orthogonal transformation operation of image data is an operation of a sum of products of a column direction data vector of a display image composed of selected data lines of elements and a column vector of an orthogonal function matrix. Data of a general image signal as used in TVs, displays for personal computers, and the like is conventionally scanned in a row direction; however, according to the active driving method, data is required to be arranged in a column direction. Thus, a data storage unit for temporarily storing data such as a frame memory is required for the purpose of rearranging a data signal.

The capacity of the data storage unit is affected by the structure of an orthogonal function matrix, i.e., the order of an operation during one frame period. According to the AA method and the dispersion type MLS method, because of the relationship of the order of the operation, a memory capacity for storing one frame of image data is required.

Furthermore, according to the AA method and the dispersion type MLS method, the same data signal is used a plurality of times during one frame period, whereby an orthogonal operation processing is completed. Therefore, when the content of data stored in a memory in one frame is changed, normal reverse transformation cannot be performed on a liquid crystal panel side.

Thus, in order to keep continuity of data between frames, another memory which allows a data signal of the next frame to be written while data is being read from a memory (i.e., during a data operation period of a frame) is required.

Hereinafter, the reason for the additional memory this will be described in detail.

In general, general-purpose memories such as a large-capacity dynamic random access memory (DRAM) have I/O in common, whereby the number (internally, bus width) of IC terminals is reduced. Therefore, I/O is appropriately switched in time sequence so that Read (out) and Write (in) processings are performed. Read (out) and Write (in) processings cannot be performed simultaneously. Thus, in the case where a double buffer processing is realized with a general-purpose memory such as an inexpensive DRAM, separate memories (i.e., a double buffer structure) for reading and writing are required.

Memory ICs, other than those of custom configurations, have a bit length (=bus width) and a word length (=address length) which determine the memory capacity of the ICs and are fixed in accordance with a certain rule (generally, exponetiation of 2). Thus, no matter how low the use efficiency of memories for reading or writing may be, independent memories for compensating for the required capacity for reading and writing are required.

Therefore, in a conventional display apparatus, as shown in FIG. 12, it is actually impossible to perform double buffer processing in which writing and reading are alternately performed by using 2 frames of memories A and B ("Study of a method for driving a high-speed response STN-LCD" (Kudo et al.), The Institute of Electric Communication Engineers of Japan, Study Report EID95-24, February, 1995). Instead, it is required for a large-capacity memory such as a frame memory to have a double buffer structure for orthogonal transformation of image data.

Thus, in a conventional driving circuit, irrespective of the degree of the use efficiency of memories, the total number of required memories (twice that required for a reading or writing processing) cannot be decreased, resulting in an increase in cost.

SUMMARY OF THE INVENTION

A driving circuit for a simple matrix type display apparatus in which an input data signal is stored in a frame buffer and subjected to orthogonal transformation, whereby a display is performed, includes: a plurality of line buffers whose number is equal to the number of selected scanning lines in accordance with a multiple-scanning line simultaneous selection method, respectively having a region I and a region II, wherein while one of the regions I and II is used for writing, the other is used for reading; and a frame buffer which allows data from the plurality of line buffers to be written during a plurality of horizontal non-display periods and allows all of the selected scanning lines of data to be written at a time, wherein the number of the selected scanning lines is equal to the number of the plurality of horizontal non-display periods.

In one embodiment of the present invention, the selected scanning lines of data is read from the frame buffer at a time during a horizontal display period.

In another embodiment of the present invention, each of the line buffers has two memory regions in which the input data signal is written by one line during corresponding horizontal display periods and the selected scanning lines of data written in the frame buffer are divided in the horizontal direction and are simultaneously read, and the data read from the line buffers is transferred to the frame buffer.

In another embodiment of the present invention, the line buffers are constructed in such a manner that a whole address length of the two memory regions has a length at least twice the number of horizontal effective pixels during one horizontal synchronization period, and the selected scanning lines of data signals to be newly written are stored until a reading of all the data divided in the horizontal direction during the plurality of horizontal non-display periods is completed.

In another embodiment of the present invention, the above-mentioned driving circuit includes a memory control circuit for controlling writing and reading of data with respect to the frame buffer and the line buffers.

In another embodiment of the present invention, the number of horizontal synchronizations of an input signal is adjusted during one frame period with an output signal to a display panel by periodically inserting non-selection periods in an orthogonal function used for orthogonal transformation on a horizontal synchronization period basis, the driving circuit further including a synchronizing signal adjusting circuit for dispersing the non-selection periods in a matrix of the orthogonal transformation, thereby allowing one synchronization system to be utilized.

In another embodiment of the present invention, during a vertical non-display period in which an input data signal is not present, the synchronizing signal adjusting circuit generates a horizontal display period signal or a horizontal non-display period signal which is the same as that in the other periods, and provides the generated signal to the memory control circuit for controlling the frame buffer and the line buffers.

In another embodiment of the present invention, the memory control circuit allows a refresh operation of the frame buffer to be performed during the dispersed non-selection periods formed by the synchronizing signal adjusting circuit.

Hereinafter, the function of the present invention will be described.

According to the present invention, each of a plurality of line buffers provided as many as scanning lines to be selected in accordance with a multiple-scanning line simultaneous selection method has a region I and a region II. While one of the two memory regions is being used for writing, the other one is used for reading. Writing data from the plurality of line buffers to the frame buffer is dispersed in a plurality of horizontal non-display periods, wherein the number of non-display periods is equal to the number of the selected scanning lines, and all the selected scanning lines of data are simultaneously written at a time. More specifically, data can be written from the line buffers to the frame buffer during a horizontal non-display period which has not used in the past. Thus, one frame buffer memory allows Read and Write to be performed.

Such line buffers respectively have two memory regions, in which an input data signal is written by one line during a corresponding horizontal display period, and the selected scanning lines of written data divided in the horizontal direction are simultaneously read during each of a plurality of horizontal non-display periods. The data read from the line buffers is then transferred to the frame buffer.

The reason why data is read from the line buffers while being divided in the horizontal direction by the number equal to that of the selected scanning lines during a plurality of horizontal non-display periods is as follows: the horizontal non-display period of the horizontal synchronization period is only ⅕ to ¼ of the entire horizontal display period; therefore in order for the whole data signal to be transferred so as to be subjected to orthogonal transformation, the whole data signal should be divided.

Furthermore, according to the present invention, the selected scanning lines of data is read from the frame buffer at a time during a horizontal display period in the same way as in a conventional example. Thus, the read data can be subjected to orthogonal transformation without fail.

According to the present invention, the line buffers have an address length at least twice the number of horizontal effective pixels during one horizontal synchronization period. Thus, a region is secured which stores a data signal to be newly written until reading of the whole data divided in the horizontal direction is completed over a plurality of horizontal non-display periods (in other words, until the reading of the next selected scanning lines of data is completed after writing).

Furthermore, according to the present invention, the memory control circuit controls the writing and reading of data with respect to the frame buffer and the line buffers, and allows a refresh operation of the frame buffer to be performed during a non-selection period generated by a synchronizing signal adjusting circuit described below.

Furthermore, according to the present invention, the synchronizing signal adjusting circuit periodically inserts non-selection periods on a horizontal synchronization period basis in an orthogonal function used for orthogonal transformation. Therefore, the decrease in contrast of a display apparatus can be minimized.

Furthermore, according to the present invention, during a vertical non-display period in which an input data signal is not present, the synchronizing signal adjusting circuit generates a horizontal display period signal or a non-display period signal which is the same as in the other periods, and provides the generated signal to the memory control circuit. Each signal is generated because the last data is read from the line buffers during a horizontal synchronization period in which a data signal is not present. The number of horizontal periods required for completing orthogonal transformation becomes larger than the number of display data lines, and it is required to continue supplying a read timing from the frame buffer during a vertical non-display period.

Thus, the invention described herein makes possible the advantage of providing a driving circuit for a simple matrix type display apparatus in which the number of memories used for a double-buffer processing can be decreased.

This and other advantages of the present invention will become apparent to those skilled in the art upon reading and understanding the following detailed description with reference to the accompanying figures.

BRIEF DESCRIPTION OF THE DRAWINGS

FIGS. 9A and 9B show an operation order in an orthogonal transformation circuit in the example according to the present invention.

DESCRIPTION OF THE PREFERRED EMBODIMENTS

The present invention will be described by way of an illustrative example with reference to the drawings.

Figure 3:
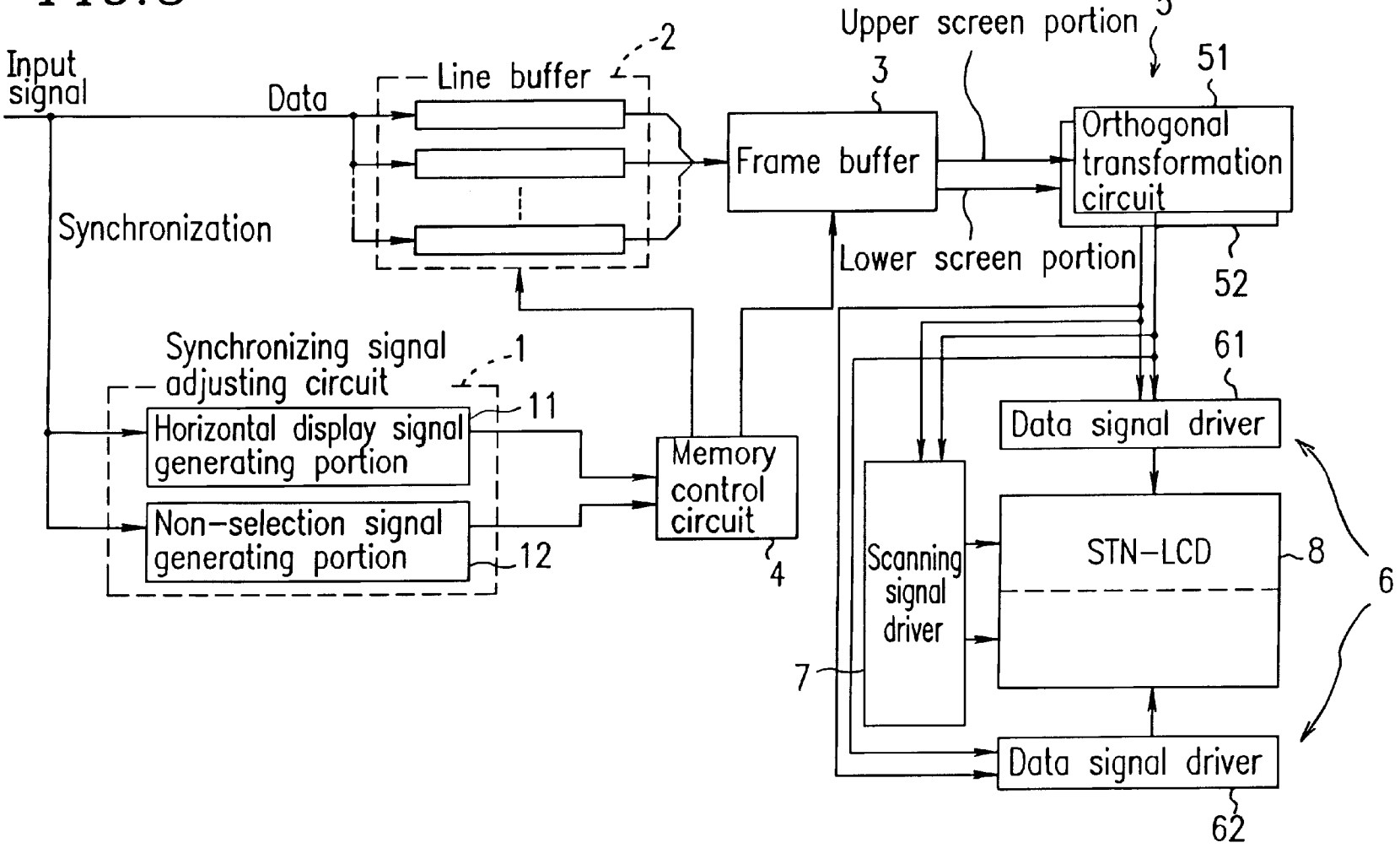
FIG. 3 is a block diagram showing a configuration of a driving circuit according to the present invention, using a multiple scanning line simultaneous selection method in which 4 scanning lines are simultaneously selected.

Referring to FIG. 3, a driving circuit of the present invention includes a synchronizing signal adjusting circuit 1, a memory control circuit 4, line buffers 2, and a frame buffer 3. During a vertical non-display period in which an input data signal is not present, the synchronizing signal adjusting circuit 1 generates a horizontal display period signal or a non-display period signal which is similar to that in the other periods based on the input vertical synchronizing signal, horizontal synchronizing signal, data effective period signal, and clock signal. The memory control circuit 4 receives the horizontal display period signal or non-display period signal. The line buffers 2 and the frame buffer 3 are controlled by the memory control circuit 4 and respectively store an input data signal. The driving circuit further includes an orthogonal transformation circuit 5, a data signal driver 6, a scanning signal driver 7, and an STN-LCD panel 8. The orthogonal transformation circuit 5 subjects the data signal read from the frame buffer 3 to orthogonal transformation with an orthogonal function. The data signal driver 6 applies a voltage to the STN-LCD panel 8 in accordance with the data signal subjected to orthogonal transformation. The scanning signal driver 7 applies a voltage corresponding to the orthogonal function used for the orthogonal transformation to the STN-LCD panel 8. The STN-LCD panel 8 reproduces the input image data, using the voltages supplied by the data signal driver 6 and the scanning signal driver 7.

Figure 1:
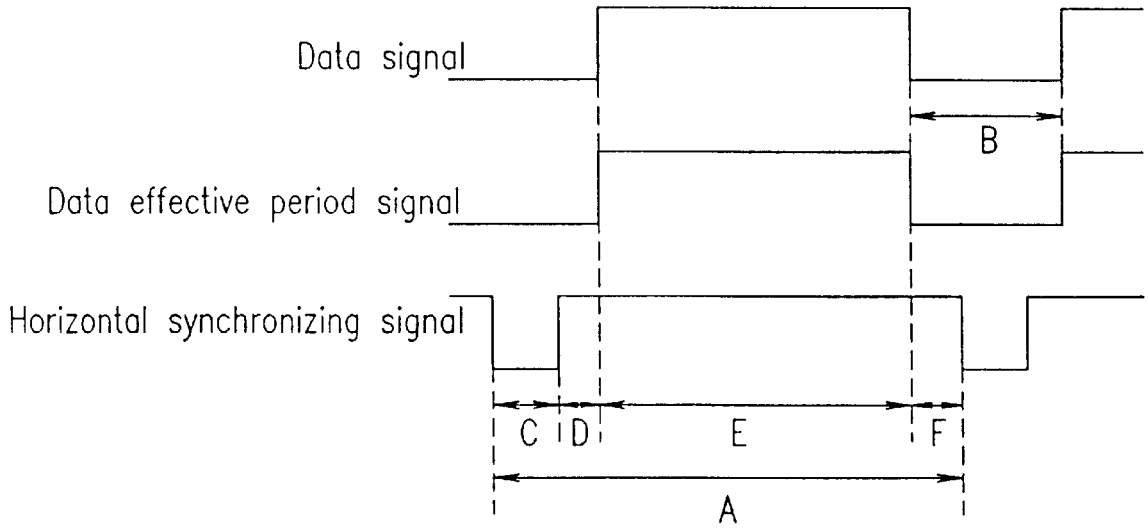
FIG. 1 is a timing diagram illustrating a horizontal non-display period used for reading data from line buffers according to the present invention.

As shown in FIG. 1, according to the present invention, a horizontal display period E of a horizontal synchronization period A of an input data signal and a horizontal non-display period B are utilized. The horizontal non-display period B corresponds to a period of time obtained by summing up a front porch F, a horizontal synchronizing pulse width C, and a back porch D which occupy about 20% of the horizontal synchronization period A. Because of this, the use efficiency of memories can be improved as described below.

It is assumed that the number of scanning lines to be simultaneously selected is n in the driving circuit which drives the STN-LCD panel 8 provided with high-speed response STN liquid crystal by subjecting an input data signal to orthogonal transformation. The memory control circuit 4 controls the line buffers 2 and the frame buffer 3 in accordance with a horizontal display period signal from the synchronizing signal adjusting circuit 1 as follows. The number of line buffers 2 is equal to the number of the scanning lines to be simultaneously selected, and each line buffer 2 has regions I and II.

Figure 2A:
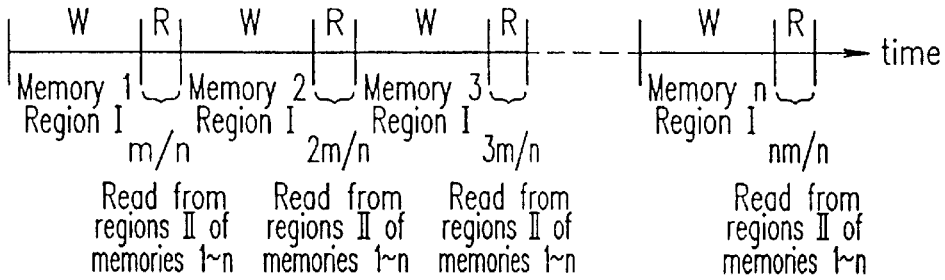
FIGS. 2A and 2B are timing diagrams showing how data is written in and read from the line buffers according to the present invention.
Figure 2B:
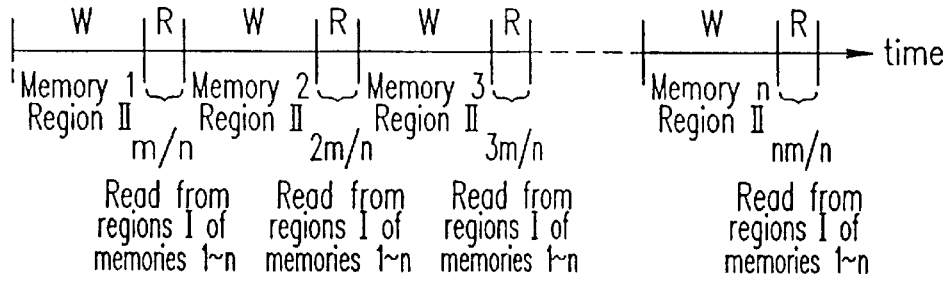

As shown in FIG. 2A, a data signal in the first line input to the driving circuit is written in a region I of the first line buffer (memory 1) during a horizontal display period W of the first horizontal synchronization period. Thereafter, data signals up to the n-th scanning line are written in the regions I of the corresponding n line buffers 2 (memories 1 to n) during each horizontal display period W up to the n-th horizontal synchronization period. In FIGS. 2A and 2B, W represents a Write period (horizontal display period), and R represents a Read period (horizontal non-display period).

When the data signal in the n-th scanning line is written in the first region of the n-th line buffer, the data signals start being read from the regions I of the n line buffers 2 from a horizontal non-display period R immediately after the data signal in the n-th scanning line is written, and the read data signals are transferred to the frame buffer 3.

The horizontal non-display period R of the horizontal synchronization period is merely ⅕ to ¼ of the horizontal display period W. Therefore, the data signal is divided in the horizontal direction by the number equal to that of the scanning lines to be simultaneously selected (i.e., divided into a plurality of horizontal non-display periods), whereby the data is read from the line buffers 2. More specifically, assuming that the number of display pixels in one line is m, m/n data signals are simultaneously read from n line buffers 2 during the first Read period R (horizontal non-display period). By dividing the data signal by n in the horizontal direction, all the data signals written in the respective regions I of the n line buffers 2 are read during n horizontal non-display periods.

In order to complete the reading of all the data signals which are written by line in the regions I during n horizontal display periods, n horizontal non-display periods are required after the data in the n-th scanning line is written. More specifically, a data signal in the 2n-th line is input to the driving circuit during a horizontal display period immediately after the nth reading is completed.

As shown in FIG. 2B, data signals in the (n+1)-th to 2n-th lines are written in regions II of the respective line buffers 2 different from the regions I. Thereafter, in a similar manner, data signals in the (2n+1)-th to 3n-th lines are written in the regions I while the data signals in the (n+1)-th to 2n-th lines are read from the regions II. As described above, the regions I and II alternately store the data signal every n lines. Thus, overlapping (i.e., while data is being read from an address of a memory, another data is written in the same address of the memory, whereby the previous data is destroyed) of a data signal is prevented.

As soon as the writing of the last data signal in the n-th scanning line (including the last line) is completed by the above procedure, n lines of data signals are divided into n segments and are read over n horizontal non-display periods, whereby a line buffer processing during one vertical synchronization period is completed. In the case where the number of lines in one frame of display data cannot be divided by n, dummy data is read.

N lines of data divided by n in the horizontal direction output from the line buffers 2 are written in the frame buffer 3, and n lines of data signals required for orthogonal transformation are simultaneously read during a horizontal display period.

It is required to perform double buffer processing for keeping continuity of data between frames in orthogonal transformation. Therefore, according to the AA method and the dispersion type MLS method, the frame buffer 3 needs a capacity of two frames. According to the non-dispersion type MLS method and an intra-block dispersion method (Japanese Laid-open Publication No. 8-146382), the frame buffer 3 needs a capacity twice as large as orthogonal function blocks. During a horizontal display period in which data in a frame (or a block) is being written in a region during a horizontal non-display period, a data signal which has been written during the frame (or block) period immediately before is read from another region.

A large-capacity buffer memory composed of a DRAM or the like requires a periodical refresh operation so as to update charge information of a memory cell.

Therefore, the synchronizing signal adjusting circuit 1 periodically inserts non-selection periods in an orthogonal function used for orthogonal transformation on a horizontal synchronization period basis, and provides dispersed non-selection period signals to the memory control circuit 4.

The memory control circuit 4 of the present invention controls writing and reading of data with respect to the frame buffer 3 and the line buffers 2 as described above, and allows the frame buffer 3 to perform a refresh operation in accordance with a non-selection period signal generated by the synchronizing signal adjusting circuit 1.

Figure 12:
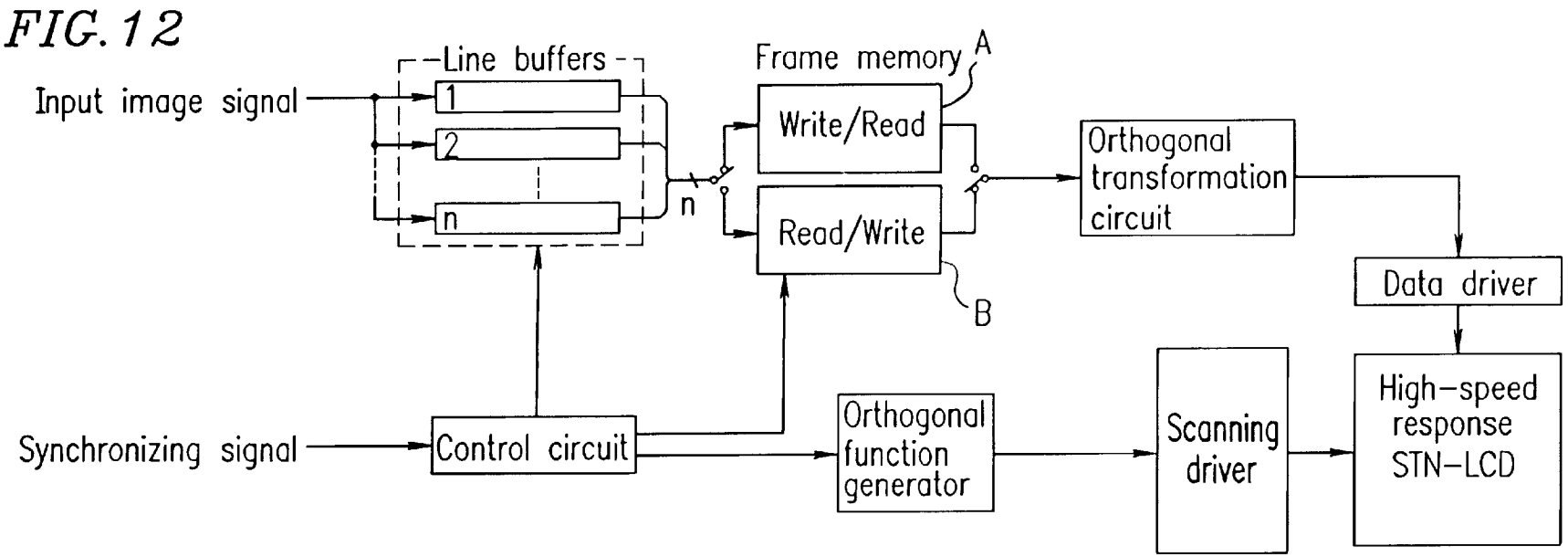
FIG. 12 PRIOR ART
FIG. 12 is a block diagram showing a double buffer processing unit provided in a conventional driving circuit.

As described above, according to the present invention, one memory system suffices, whereas two memory systems are required in a conventional frame buffer as shown in FIG. 12. Thus, the number of memory systems can be reduced.

According to the present invention, the I/O switching time of the frame buffer 3 and the line buffers 2 should be secured, while the horizontal non-display period R of the horizontal synchronization period is merely about ⅕ to ¼ of the horizontal display period W. Therefore, the number of line buffers 2 and the number of scanning lines to be simultaneously selected are required to be at least 4.

EXAMPLE

FIG. 3 is a block diagram of a driving circuit of an example according to the present invention. In this driving circuit, an intra-block dispersion driving method (Japanese Laid-open Publication No. 8-146382) using up-and-down division driving in which the number of scanning lines to be simultaneously selected is 4 and the number of block lines is 150 is applied to a high-speed response STN-LCD having a resolution of 800 H (dots/RGB)×600 V (lines).

The driving circuit of the present example will be described in more detail, although having been described above.

The driving circuit of the present example includes a synchronizing signal adjusting circuit 1. The synchronizing signal adjusting circuit 1 includes a horizontal display signal generating portion 11 and a non-selection signal generating portion 12. The horizontal display signal generating portion 11 generates a horizontal display period signal over one frame period from an input synchronizing signal. The non-selection signal generating portion 12 generates a non-selection period signal which almost periodically inserts non-selection periods in an orthogonal function on a horizontal synchronization period basis from the input synchronizing signal. The driving circuit further includes line buffers 2 and a frame buffer 3. The line buffers 2 write a data signal input to the driving circuit by one line per horizontal display period, divide 4 lines of data by 4 in the horizontal direction, and simultaneously read 4 (which is equal to the number of the scanning lines in which data is written) lines of data during 4 (which is equal to the number of selected scanning lines) horizontal non-display periods. The frame buffer 3 divides the data signal transmitted from the line buffers 2 into 4 (which is equal to the number of the selected scanning lines) horizontal non-display periods, simultaneously writes 4 lines of data, and simultaneously reads 4 lines of data during a horizontal display period.

The line buffers 2 and the frame buffer 3 are controlled by a memory control circuit 4. The control by the memory control circuit 4 is based on a horizontal display period signal from the horizontal display signal generating portion 11 and a non-selection period signal from the non-selection signal generating portion 12.

The data signal read from the frame buffer 3 is given to an orthogonal transformation circuit 5, where the data signal is subjected to orthogonal transformation with an orthogonal function. The data signal which has been subjected to orthogonal transformation is given to a data signal driver 6 and a scanning signal driver 7. In the present example, up-and-down division driving is performed. Therefore, the data signal driver 6 is composed of two data signal drivers 61 and 62. The scanning signal driver 7 includes two signal processing systems. Furthermore, the orthogonal transformation circuit 5 includes an orthogonal transformation circuit 51 on an upper screen portion and an orthogonal transformation circuit 52 on a lower screen portion.

The data signal driver 6 generates a voltage in accordance with the data signal which has been subjected to orthogonal transformation and applies it to an STN-LCD panel 8. The scanning signal driver 7 generates a voltage corresponding to the orthogonal function used for the orthogonal transformation and applies it to the STN-LCD panel 8. The STN-LCD panel 8 reproduces the input data signal using the voltages supplied by the data signal driver 6 and the scanning signal driver 7, and displays an image in accordance with the reproduced signal.

Figures 4, 5:
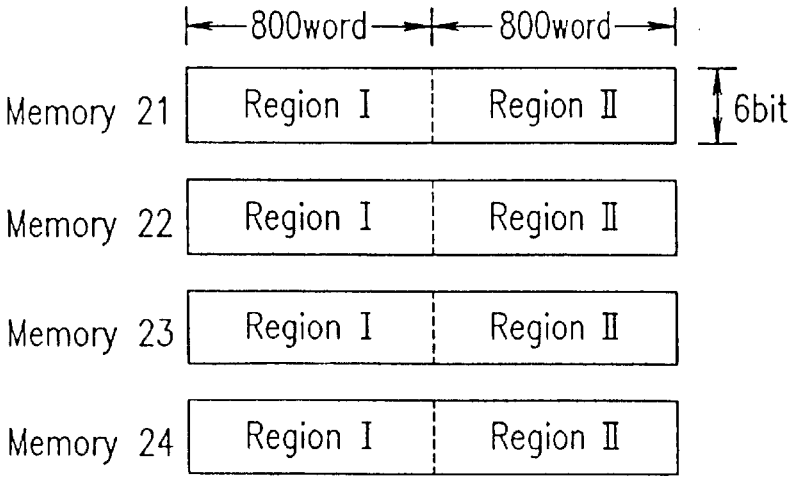
FIG. 4 shows a summary of an input signal specification in the example according to the present invention.
FIG. 5 is a diagram showing a configuration of line buffers in the example according to the present invention.

FIG. 4 shows an exemplary specification of a signal input to the driving circuit of the present example. It is assumed that video information input to the driving signal is digitized. The input data signal is a single scan signal, so that it is transformed into a dual scan signal in accordance with Japanese Patent Application No. 7-69988, whereby up-and-down driving is performed. Furthermore, the clock frequency of the data signal read from the frame buffer 3 is made equal to that input to the driving circuit, whereby the data signal input to the driving circuit is transformed at a double speed.

Furthermore, in the present example, it is assumed that multi-level gray scale information included in the data signal input to the driving circuit previously has its RGB decreased up to 2 bits by frame rate control (FRC) or a dither display in a signal source such as a graphic controller. Furthermore, in the present example, it is assumed that electric potentials corresponding to higher-order bits and lower-order bits of gray-scale information are combined on a panel module side per certain period, for example, in accordance with Japanese Patent Application No. 8-70785, whereby a natural multi-level gray scale display required in moving pictures is performed. The multi-level gray scale display in the present example can be performed with the smaller number of gray scale bits, compared with a pulse width modulation gray-scale system and an amplitude modulation gray-scale system. The multi-level gray scale display is advantageous in terms of circuit size and power consumption. Furthermore, since the multi-level gray scale display can be performed with a smaller number of frames, compared with a conventional simple FRC, screen flickering caused by the FRC can be minimized.

Hereinafter, the mechanism of the driving circuit of the present example will be described along with the flow of a data signal.

As described above, the synchronizing signal adjusting circuit 1 includes the horizontal display signal generating portion 11 and the non-selection signal generating portion 12. During a vertical non-display period in which an input data signal is not present, the horizontal display signal generating portion 11 generates a horizontal display period signal which is similar to that in the other periods from an input synchronizing signal. The horizontal display signal generating portion 11 gives the generated signal to the line buffers 2 and the frame buffer 3. In the present example, the number of vertical effective display lines is 600 among 628 horizontal synchronization periods in one frame, so that the vertical non-display period includes 28 horizontal synchronization periods.

According to the orthogonal function matrix of the present example, i.e., the sequence on a panel module side, 4 lines out of 150 lines in one block are simultaneously selected, and there are two blocks respectively in the upper and lower screen portions. Therefore, one frame is completed with the following horizontal periods.

The horizontal periods required for scanning one block is obtained as follows: 150 (the number of lines in one block) ÷4 (the number of lines to be simultaneously selected)=37.5. The integer larger than this value is 38. This value (i.e., 38) is multiplied by the basic matrix order at a time of simultaneously selecting 4 lines and the number of blocks in each screen portion. Thus, the horizontal periods required for completing one frame can be obtained.

The basic matrix order refers to the k-th power of 2 (wherein k is a natural number) which is the smallest number of lines to be simultaneously selected. In this case, the basic matrix order is 4 ($=2^2$) which is equal to the number of lines to be simultaneously selected. The number of blocks in each screen is 2.

Thus, the horizontal periods required for completing one frame is 38×4 (basic matrix order at a time of simultaneously selecting 4 lines)×2 (the number of blocks in each screen portion)=304. Thus, one frame is completed with 304 horizontal periods. In the present example, since an input data signal is transformed at double speed, 628 input horizontal synchronization periods in one frame correspond to 608 horizontal periods in two frames on a panel module side.

When a horizontal synchronizing signal on an input side is used as a horizontal period signal on a panel module side, it is required to insert non-selection periods which are not related to a display by 20 horizontal synchronization periods on the panel module side.

In the present example, the non-selection signal generating portion 12 sets a non-selection period of one horizontal synchronization period every 38 horizontal synchronization periods, and gives a non-selection period signal to the memory control circuit 4. Because of the insertion of the non-selection periods, the sequence on the panel module side becomes 39×4 (basic matrix order at a time of simultaneously selecting 4 lines)×2 (the number of blocks in each screen portion)×2 (double speed)=624. The non-selection periods can be almost equally dispersed, whereby the decrease in contrast on the panel module side can be minimized. Regarding 4 lacking horizontal synchronization periods, the non-selection periods can be disposed after 624 horizontal synchronization periods of 2 frame sequence on the panel module side.

In the present example, the number of scanning lines to be simultaneously selected is 4, so that the line buffers 2 are composed of 4 memories 21 to 24 as shown in FIG. 5. Each of the memories 21 to 24 includes a region I and a region II. The required bit length is 6 bits (RGB×2 bits) and the required word length is 1600 words (800 dots×2). Hereinafter, among the 1600 words, addresses 0 to 799 will be referred to as the first region (region I) and addresses 800 to 1599 will be referred to as the second region (region II).

Figure 6A:
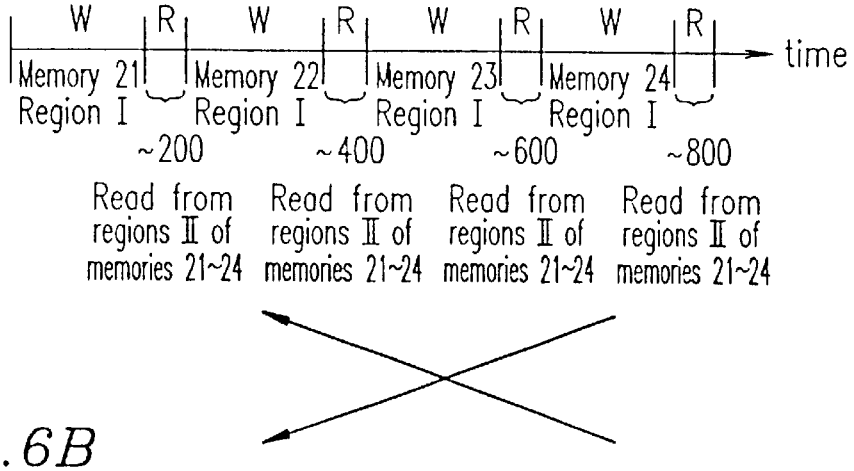
FIGS. 6A and 6B show a configuration of the line buffers and the reading and writing of data in the example according to the present invention.
Figure 6B:
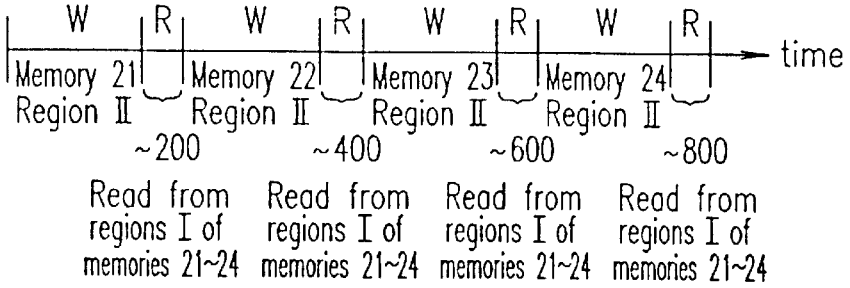

A data signal in the first line input to the driving circuit is written in the first region of the memory 21 during a horizontal display period of the first horizontal synchronization period as shown in FIG. 6A. Likewise, data signals in the second to fourth lines are written in the regions I of the memories 22 to 24 during the respective horizontal display periods corresponding to the data signals. Data signals in the following fifth to eighth lines are written in the regions II of the memories 21 to 24 during the respective horizontal display periods as shown in FIG. 6B. Thereafter, input data is alternately written in the regions I and II of the memories 21 to 24 during the horizontal display periods every 4 lines from the 597th to 600th lines.

Regarding reading data from the memories 21 to 24, the first 200 dots of data signals are simultaneously read from the regions I of the memories 21 to 24 during a horizontal non-display period immediately after the data signal in the fourth line is written in the first region of the memory 24. Thereafter, in the same way, 800 dots of data signals written in the regions I of the memories 21 to 24 are simultaneously read by 4 lines during dispersed 4 horizontal non-display periods. The data signals thus read are simultaneously transferred to the frame buffer 3 by 4 lines and 24 bits (4 lines×RGB×higher-order·lower order bits).

When the reading of 800 dots of the data signals written in the regions I of the memories 21 to 24 is completed, data is read from the regions II of the memories 21 to 24 during the next 4 horizontal non-display periods. As described above, data is alternately read from the regions I and II every 4 horizontal non-display periods.

In the above-mentioned procedure, the data signals in the 597th to 600th lines are written in the regions II. Immediately after this, each of the data signals (200 dots) are read during 4 horizontal non-display periods, whereby the processing by the line buffers 2 during one vertical synchronization period is completed.

The capacity and structure of the frame buffer 3 will now be described below.

The capacity required for writing data in the frame buffer 3 is calculated as follows. RGB respectively requires 2 bits, and the assignment of 4 lines of data (4 lines are simultaneously selected) to the bit direction corresponds to that 4 lines are simultaneously read. Thus, the required capacity becomes 24 bits (2 bits×RGB×4 lines).

One block includes 150 lines in the word direction. Four lines are simultaneously selected out of 150 lines; thus, 150÷4=37.5. The upper and lower screen portions respectively have a double buffer structure. Therefore, 37.5×2 (double)×2 (U/L)=150. The number of pixels in one line is 800 dots; thus, 150×800=120000. That is, 120000 words are required in total. Thus, the minimum capacity of the frame buffer required in one frame is 24 bits×120000 words=2880000≈2.8 Mbits.

Figure 7:
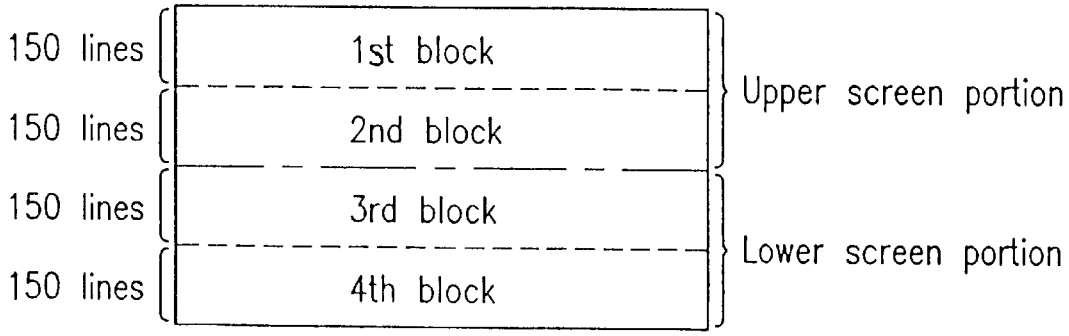
FIG. 7 is a diagram illustrating blocks which form a display in the example according to the present invention.

As shown in FIG. 7, the 1st to 150th lines of the upper screen portion of an LCD panel will be referred to as a first block, the 151st to 300th lines of the upper screen portion will be referred to as a second block, the 1st to 150th lines of the lower screen portion will be referred to as a third block, and the 151st to 300th lines of the lower screen portion will be referred to as a fourth block. In the present example, since a data signal input to the driving circuit is a single scan signal, 6 bits of data signals (i.e., 2 bits each of RGB) are input to the driving circuit in the order of the first, second, third, and fourth blocks (Single Scan). In the case of Dual Scan, the operation results of the data signals of the first and second blocks are alternately input in the upper screen portion on the panel side. Similarly, the operation results of the data signals of the third and fourth blocks are alternately input in the lower screen portion on the panel side.

Thus, in the frame buffer having a configuration of 24 bits×120000 words, the data signals in the upper screen portion (first and second blocks) and in the lower screen portion (third and fourth blocks) are required to be assigned in separate addresses in terms of the input order of the data signals. Therefore, the data in the upper and lower screen portions cannot be simultaneously read. In order to solve this problem, two frame memories of 12 bits×120000 words=1440000≈1.4 Mbits are used for the frame buffer 3. Hereinafter, two frame memories will be denoted by the reference numerals 31 and 32.

According to a configuration of the frame buffer to which the present invention is not applied, two frame buffers for reading the upper and lower screen portions are required. If a double buffer processing is respectively performed in the upper and lower screen portions, 4 frame memories in total are required. In general, a frame memory has a large capacity, so that the increase in the number of memories decreases their use efficiency.

According to the present invention, the use efficiency of a frame memory can be doubled as follows. The frame memories 31 and 32 of the present example can be respectively composed of, for example, an SDRAM (synchronous DRAM) of 2 Mbits (16 bits×131072 words, 256 rows×256 columns×2 banks). In the case of applying the present invention, the use efficiency becomes about 70% (2.88 Mbits÷(2 Mbits×2 pieces)×100). This means that the use efficiency doubles with respect to about 35% in the case where double buffer processing is simply performed. Thus, according to the present invention, one buffer memory system suffices, while two buffer memory systems are required for performing a conventional double buffer processing. Therefore, the number of memories in the present invention can be reduced. The present example has a structure in which up-and-down driving is performed, so that the number of memories appears to be the same as that shown in FIG. 12. However, the number of memories can be reduced, compared with a conventional example in which up-and-down division driving is performed.

Figures 8, 10:
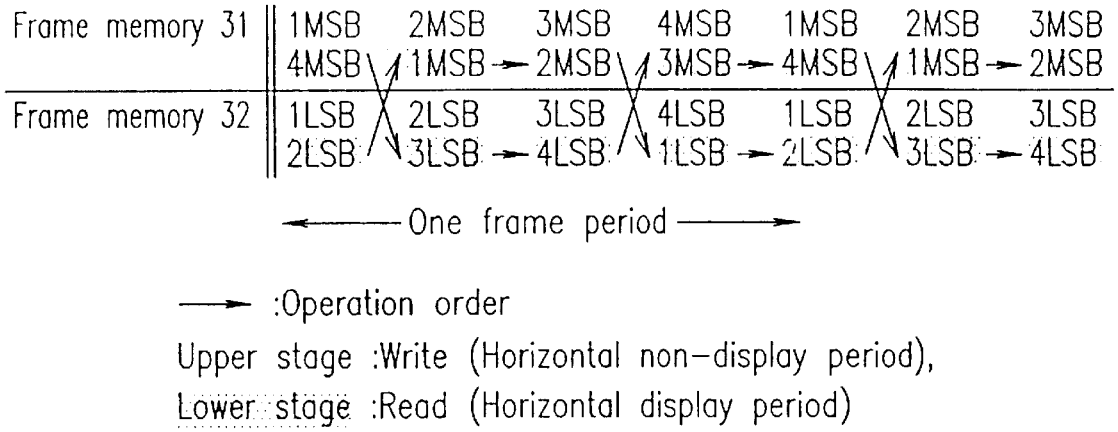
FIG. 8 is a diagram showing the reading and writing of data with respect to a frame buffer in the example according to the present invention.
FIG. 10 is a diagram showing selection and non-selection in one frame displayed in the operation order of FIGS. 9A and 9B.
Figure 11:
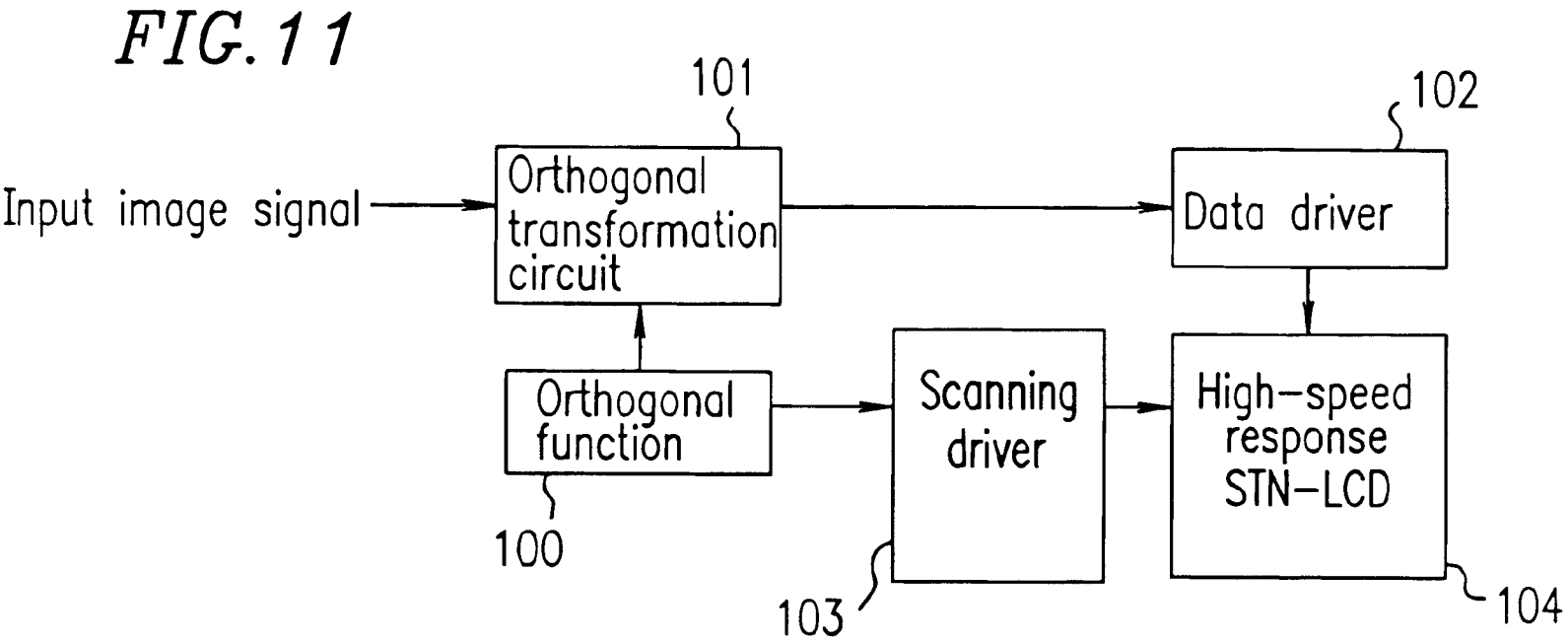
FIG. 11 PRIOR ART
FIG. 11 is a block diagram showing a conventional driving circuit.

With four lines of the data signal simultaneously read from the memories 21 to 24 of the line buffers 2 during a horizontal non-display period, the higher-order bits of the gray scales are written in the frame memory 31, and the lower-order bits of the gray scales are written in the frame memory 32, successively, as shown in FIG. 8. In FIG. 8, the values 1 to 4 correspond to the first to fourth blocks of FIG.

7, M represents a higher-order bit portion, and L represents a lower-order bit portion. The upper stage of each of the frame memories 31 and 32 corresponds to a horizontal non-display period W and the lower stage corresponds to a horizontal display period R.

Data is read from the frame memories 31 and 32 of the frame buffer 3 at a timing which is shifted by about ¼ with respect to one frame period of an input signal as shown in FIG. 8. More specifically, 4 lines of data required for operation start being read in accordance with an orthogonal function matrix from a horizontal display period immediately after writing of 601 to 800 dots of data signals in the 148th to 152nd lines transmitted from the line buffers 2 is completed.

In the present example, one block includes 150 lines. However, when 150 lines are selected by 4 lines on a horizontal period basis, 4 lines (i.e., 145th line, 146th line, 147th line, and 148th line) are simultaneously selected after 37 horizontal periods, and the boundary of the blocks is reached during the next 38th horizontal period. Therefore, 2 lines are lacking. Thus, this inconvenience is overcome by setting the size of one block at 152 lines. More specifically, the physical size of the first and third blocks is set at 152 lines, and the size of the second and fourth blocks is set at 152 lines (148 lines (physical size of a block)+4 lines (virtual lines which are not present in a panel)). Thus, the size of each block is set at the number which is double the number of scanning lines to be simultaneously selected, and the size is aligned, whereby the operation of the driving circuit is simplified.

The memory control circuit 4 controls the reading and writing of data with respect to the line buffers 2 in accordance with a horizontal display period signal from the synchronizing signal adjusting circuit 1. The memory control circuit 4 basically controls the frame buffer 3 in accordance with the horizontal display period signal from the synchronizing signal adjusting circuit 1. However, the period during which a non-selection period signal from the synchronizing signal adjusting circuit 1 is effective corresponds to an operation period with 0 element of the orthogonal function matrix, so that data is not read during this period, and the frame memories 31 and 32 are allowed to perform a refresh operation.

As described above, the data signal read from the frame buffer 3 is subjected to orthogonal transformation in the orthogonal transformation circuit 5. However, in this state, the higher-order bits of the gray-scale data are read from the frame memory 31 and the lower-order bits of the gray-scale data are read from the frame memory 32 in the order of the blocks, and the blocks are not arranged in accordance with the upper and lower screens portions (orthogonal operation order).

In the orthogonal transformation circuit 5, as shown in FIG. 8, data buses are switched every two blocks before or after orthogonal transformation. Thus, the data signals of the first and second blocks subjected to orthogonal transformation are given to the data signal driver 61 for the upper screen portion, and the data signals of the third and fourth blocks subjected to orthogonal transformation are given to the data signal driver 62 for the lower screen portion. As shown in FIGS. 9A and 9B, in the orthogonal transformation circuit 51 on the upper screen portion, only the data signals of the first and second blocks are subjected to orthogonal transformation, and in the orthogonal transformation circuit 52 on the lower screen portion, only the data signals of the third and fourth blocks are subjected to orthogonal transformation.

Because of the above-mentioned bus switching, the operation results of the higher-order bits and the lower-order bits of the gray scales of the first and second blocks are alternately input to the data signal driver 61 at 120 Hz, and the operation results of the higher-order bits and lower-order bits of the gray scales of the third and fourth blocks are alternately input to the data signal driver 62 per 120 Hz. As a result, one frame of display can be performed in the STN-LCD panel 8, as shown in FIG. 10.

The data signal drivers 61 and 62 respectively apply voltages to the STN-LCD panel 8 in accordance with the orthogonal operation results of the data in the upper and lower screen portions. The scanning driver 7 applies a voltage corresponding to the orthogonal function used for the orthogonal transformation to the STN-LCD panel 8.

The STN-LCD panel 8 reproduces an image in accordance with a data signal input to the driving circuit using the voltages synchronously supplied from the data drivers 61, 62 and the scanning driver 7 in a state as shown in FIG. 10. At this time, the amplitudes of the voltages applied during the reproduction of an image of the higher-order bits and the lower-order bits in the upper and lower screen portions are changed, and the FRC and the Dither display which are signal sources are combined, whereby a gray-scale display is performed.

As described above, according to the present invention, in a driving circuit which drives a simple matrix type display apparatus such as a high-speed response type STN liquid crystal display apparatus by performing orthogonal transformation of data, the use efficiency of a large-capacity buffer memory can be enhanced, and the number thereof can be reduced.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. A driving circuit for a simple matrix type display apparatus in which an input data signal is stored in a frame buffer and subjected to orthogonal transformation, said driving circuit comprising:

a plurality of line buffers having a number equal to a number of selected scanning lines selected in accordance with a multiple-scanning line simultaneous selection method, each of said plurality of line buffers having a first region and a second region, wherein while one of the first and second regions is used for writing, the other region is used for reading; and a frame buffer which enables data from the plurality of line buffers to be written during a plurality of horizontal non-display periods and enables all of the selected scanning lines of data to be written at a same time, wherein the number of the selected scanning lines is equal to the number of the plurality of horizontal non-display periods.

2. A driving circuit for a simple matrix type display apparatus according to claim 1, wherein the selected scanning lines of data are read from the frame buffer at a time during a horizontal display period.

3. A driving circuit for a simple matrix type display apparatus according to claim 1, wherein each of the line buffers has two memory regions in which the input data signal is written by one line during corresponding horizontal display periods and the selected scanning lines of data written in the frame buffer are divided in the horizontal direction and are simultaneously read, and the data read from the line buffers is transferred to the frame buffer.

4. A driving circuit for a simple matrix type display apparatus according to claim 1, wherein the line buffers are constructed in such a manner that a whole address length of the two memory regions has a length at least twice the number of horizontal effective pixels during one horizontal synchronization period, and the selected scanning lines of data signals to be newly written are stored until a reading of all the data divided in the horizontal direction during the plurality of horizontal non-display periods is completed.

5. A driving circuit for a simple matrix type display apparatus according to claim 1, comprising a memory control circuit for controlling writing and reading of data with respect to the frame buffer and the line buffers.

6. A driving circuit for a simple matrix type display apparatus according to claim 5, wherein the number of horizontal synchronizations of an input signal is adjusted during one frame period with an output signal to a display panel by periodically inserting non-selection periods in an orthogonal function used for orthogonal transformation on a horizontal synchronization period basis, the driving circuit further comprising a synchronizing signal adjusting circuit for dispersing the non-selection periods in a matrix of the orthogonal transformation, thereby allowing one synchronization system to be utilized.

7. A driving circuit for a simple matrix type display apparatus according to claim 6, wherein during a vertical non-display period in which an input data signal is not present, the synchronizing signal adjusting circuit generates a horizontal display period signal or a horizontal non-display period signal which is the same as that in the other periods, and provides the generated signal to the memory control circuit for controlling the frame buffer and the line buffers.

8. A driving circuit for a simple matrix type display apparatus according to claim 6, wherein the memory control circuit allows a refresh operation of the frame buffer to be performed during the dispersed non-selection periods formed by the synchronizing signal adjusting circuit.

* * * * *